United States Patent [19]

Tegg

[11] Patent Number: 4,629,230

[45] Date of Patent: Dec. 16, 1986

[54] CLOSURE FASTENER

[75] Inventor: Duane T. Tegg, Brooklyn Center, Minn.

[73] Assignee: Satellite Industries, Inc., Minneapolis, Minn.

[21] Appl. No.: 780,633

[22] Filed: Sep. 26, 1985

[51] Int. Cl.[4] ..... E05C 21/02

[52] U.S. Cl. ..... 292/281

[58] Field of Search ..... 292/281, 302, 341.18, 292/341.19; 52/633; 403/2, 408.1

[56] References Cited

U.S. PATENT DOCUMENTS

| | | | |
|---|---|---|---|
| 702,605 | 6/1902 | Voight | 292/341.18 |
| 1,022,839 | 4/1912 | Gorschi | 292/281 |
| 2,275,760 | 3/1942 | Hoffman | 292/281 |
| 2,428,207 | 9/1947 | Dzurinda | 292/340 |
| 2,439,036 | 4/1948 | Bohnsack | 292/341.18 |
| 2,572,428 | 10/1951 | Anstine | 292/341.18 |
| 2,638,368 | 5/1953 | Weinberg | 403/2 |
| 2,733,786 | 2/1956 | Drake | 52/633 |
| 3,572,064 | 3/1971 | Bracknell et al. | 292/281 X |
| 3,736,016 | 5/1973 | Garvey et al. | 292/281 |

*Primary Examiner*—Richard E. Moore

*Attorney, Agent, or Firm*—John C. Barnes

[57] ABSTRACT

Closure elements for a building structure wherein each of the elements are identical and each element is an angular member having a plate formed with a diagonal slot and a leg with a plurality of holes for receiving fastening elements.

4 Claims, 2 Drawing Figures

CLOSURE FASTENER

BACKGROUND OF THE INVENTION

1. Field of the Invention

This invention relates to an improvement in closure fasteners for use with fastening elements such as padlocks to secure a closure, and in one aspect, to an improved closure fastener wherein fatigue or displacement of one member from alignment with the other structural member does not restrict the closure fasteners from receiving the fastening element.

2. Description of the Prior Art

Hasp structures are known which are designed to afford adjustment such that a misalignment of the fixed structure and the movable member or door does not totally restrict operation of the hasp. Examples of hasps having adjustable members are shown in U.S. Pat. Nos. 2,275,760 and 2,428,207. In each of these patents the hasps or the staple element are slidable in grooves perpendicular to each other to afford adjustment of the slot in the hasp with the staple such that the two will interfit. The greatest range of adjustment which might be effective in the event of the door element sagging with respect to the frame is illustrated in FIG. 4 of U.S. Pat. No. 2,418,207, wherein the hinged metal strap can slide in a slot 36 and also pivot slightly to maintain a parallel relationship with the staple 26 even though the door 30 were to sag with respect to the frame 27.

In this construction however there are numerous expensive parts to affect the adjustability of the closure such that it can receive the padlock shackle through the staple 26 even though there is some misalignment.

In applicant's invention the closure fastener includes two identical parts. The two parts are positioned one on the fixed structure and one on the movable structure to be generally aligned with one another when the movable structure or door is in the closed position. Misalignment either due to sagging of the door unit or some increase in the separation between the door units at the closure line do not restrict the acceptance of the padlock shackle through the closure elements to secure the door.

The numerous advantages of the closure structure of the present invention will be made obvious after reading the following description.

SUMMARY OF THE INVENTION

A closure fastener comprising two generally rectangular steel plates and means for attaching the plates to a fixed structure and to a movable member. The plates are affixed to the structures to be placed in a generally juxtaposed parallel relationship when the members are brought together in the position where closure is desired. Each of the plates have a diagonally disposed slot with the slot in one plate being disposed at an angular relation with respect to the other slot or with the two slots forming a generally cruciformed shape. Each slot has a width sufficient to receive the shackle of a padlock fastening element.

The means for attaching the plates comprise a leg integral with the plates and disposed at a right angle to the plates. The legs are each formed with openings for receiving a mechanical fastener such as screws, bolts or rivets. Preferably, the closure elements are secured by frangible rivets such that when a tool is used to pry the closure element off the structure and obtain access through the closure the rivets will break free before the fixed or movable members of the building unit are damaged or before the fastening structure is destroyed. The closure elements are designed for use in securing the door of a small building unit such as a portable chemical toilet.

BRIEF DESCRIPTION OF THE DRAWING

The present invention will be further described with reference to the accompanying drawing wherein.

DESCRIPTION OF THE PREFERRED EMBODIMENTS

Figure 1:
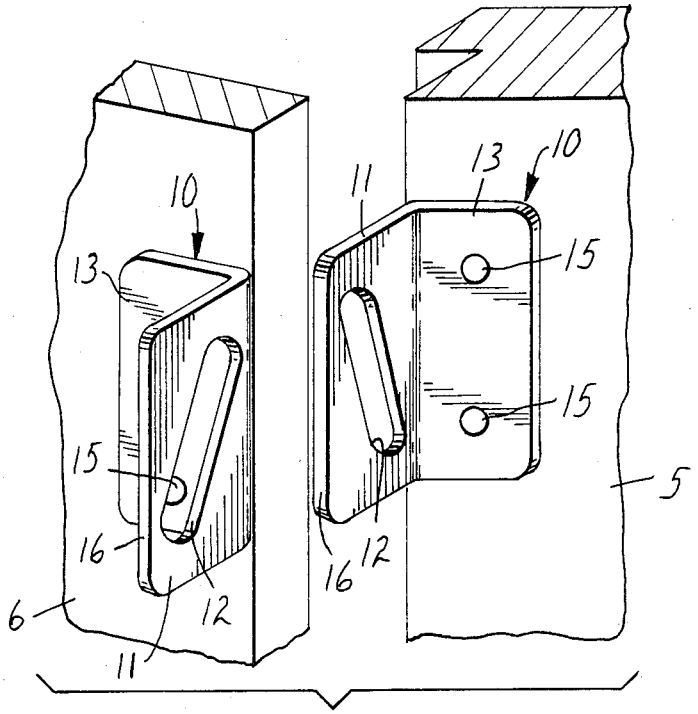
FIG. 1 is a perspective view of the closure fastener of the present invention attached to a structure.

Referring now to the drawing it will be seen in FIG. 1 that a fixed door frame structure 5 is provided to receive a door unit 6 which is movable from an open position to a closed position. On each of the members 5 and 6 is disposed a closure element 10. The closure element 10 disposed on the structure 5 is inverted with respect to the closure element 10 on the door 6.

The closure element 10 comprises a first rectangular plate 11 which is formed with a slot 12 extending generally diagonal with respect to the plate 11. The slot 12 has a width sufficient to receive the shackle of a padlock fastening element. Attached to and integral with the plate 11 is a leg 13 also of generally rectangular shape defining with the plate 11 an angle member. The leg 13 provides means for affixing the plate 11 to the building structure. The leg 13 is formed with a plurality of holes to receive mechanical fastening elements to hold the same to the structure.

As illustrated, the leg 13 has two holes in which are disposed rivets 15 which extend through the fixed structure 5 or the door structure 6. Preferably the rivets 15 are frangible rivets such as pop rivets which are readily applied to assemble the closure elements to the building structure. Alternative fastening elements are screws, or bolts and nuts.

Figure 2:
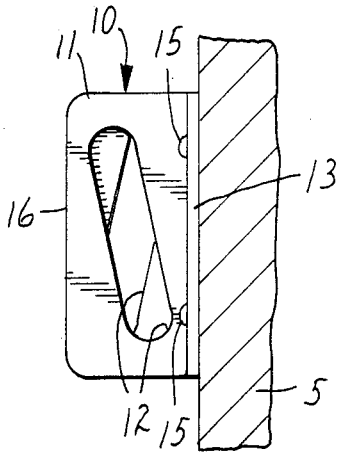
FIG. 2 is a side elevational view of the closure fastener elements when in the fastening position.

As shown in FIG. 2, with the door element 6 in closed position with respect to the fixed structure 5, the plates 11 are generally aligned with each other in juxtaposed parallel relationship. When so positioned, the slot 12 in each of the plate portions of the closure elements define a cruciform shape wherein the slots cross one another in an angular relationship, but, in any position the slots define an opening through the two plates 11 sufficient to receive the shackle of a padlock.

Since the closure elements are identical, the numbers of parts inventoried etc. is reduced. To apply a closure element to each of the fixed and the movable structure the elements will inherently be assembled properly such that the slots are positioned at an angle with respect to each other such that if either the door or the frame structure sags, twists, or cannot be pulled as tightly together as when originally assembled, the closure fastener provides aligned openings in the closure elements to receive the shackle of the padlock.

In an illustrative example, the closure elements 10 are made of 14 guage cold rolled steel and the plate portions 11 are generally 1.75 inches by 0.88 inch, and the slots have a long axis extending generally diagonally of the plate portion or at an angle of 15 degrees to the outside edge 16 thereof. The slots are formed with radiused ends, the radii of which are 0.188 inch.

Having described the present invention with respect to a preferred embodiment what is claimed is:

1. A closure fastener comprising, two rectangular plates, means for attaching one of said plates to a fixed structure and for attaching the other of said plates to a movable structure to bring the plates to a generally juxtaposed parallel relationship, said plates each having a diagonally disposed slot with the slot in one plate disposed with the longitudinal axis of said slot disposed in an angular relationship to the diagonally disposed slot in the other plate when the plates are generally parallel, each said slot has a width sufficient to receive the shackle of a padlock fastening element.

2. A closure fastener according to claim 1 wherein said means for attaching said plates comprise a leg which is unitary to the plate and disposed at a angle thereto and adapted to receive fastening elements for attachment thereof to the fixed structure and movable member.

3. A building structure comprising a fixed frame structure and a movable door unit, a closure element fastened to each said fixed structure and to said movable unit, each closure element comprising a generally rectangular plate portion and an angularly disposed leg portion, said plate portion being formed with a diagonally disposed slot having a width sufficient to receive the shackle of a padlock and said leg portion being formed with a plurality of holes for receiving fastening elements, and frangible fastening elements disposed through said holes and said fixed structure and said movable unit to position said plate portions of said closure elements in generally juxtaposed parallel relationship with the slots in said elements forming a cruciform pattern.

4. A closure fastener comprising, two identical angle members each comprising a rectangular plate and a leg perpendicular to the plane of the plate, said legs being formed with at least two holes for attaching the leg of one of said angle members to a first structure and the leg of the other angle member to a relatively movable structure to bring the plates to a generally juxtaposed parallel relationship, said plates of said angle members each having a diagonally disposed slot whereby, with the plates in juxtaposed position and said legs extending outwardly from both of said plates the longitudinal axis of the slots are disposed at an angular relationship, and said slots having a width sufficient to receive the shackle of a padlock fastening element.

* * * * *